US010894197B2

(12) United States Patent
Searcy

(10) Patent No.: US 10,894,197 B2
(45) **Date of Patent: *Jan. 19, 2021**

(54) YOGA BAG

(71) Applicant: Daniel Searcy, Sacramento, CA (US)

(72) Inventor: Daniel Searcy, Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/814,099

(22) Filed: Mar. 10, 2020

(65) Prior Publication Data

US 2020/0282284 A1 Sep. 10, 2020

Related U.S. Application Data

(63) Continuation-in-part of application No. 16/297,184, filed on Mar. 8, 2019, now Pat. No. 10,688,371.

(51) Int. Cl.

| | |
|---|---|
| ***A45C 13/38*** | (2006.01) |
| ***A63B 71/00*** | (2006.01) |
| ***A45F 3/14*** | (2006.01) |
| ***A63B 21/00*** | (2006.01) |

(52) U.S. Cl.

CPC ..... *A63B 71/0036* (2013.01); *A45F 3/14* (2013.01); *A63B 21/4037* (2015.10); *A45F 2003/142* (2013.01)

(58) Field of Classification Search

CPC ..... A63B 71/0036; A63B 2210/50; A63B 21/4037; A45C 2003/007; A45C 5/06; A45C 13/02; A45C 2013/026

USPC ..... 224/200, 251

See application file for complete search history.

(56) References Cited

U.S. PATENT DOCUMENTS

| | | | | |
|---|---|---|---|---|
| D389,642 | S | 1/1998 | Nadel | |
| 6,176,403 | B1 * | 1/2001 | Svare | A45F 5/00 224/251 |
| 6,454,683 | B1 * | 9/2002 | Kaye | A47B 83/045 482/142 |
| 6,491,196 | B1 | 12/2002 | Coler | |
| 9,055,805 | B2 * | 6/2015 | Koutouras | A45F 3/04 |
| 9,351,553 | B2 | 5/2016 | Air | |
| 9,669,253 | B2 | 6/2017 | Fleming | |
| 9,776,033 | B2 | 10/2017 | Fasullo | |
| 9,950,208 | B2 | 4/2018 | Willis | |
| D824,667 | S | 8/2018 | Perry | |
| 10,092,791 | B2 * | 10/2018 | Donnelly | B65D 21/0204 |
| 2004/0149600 | A1 * | 8/2004 | Wolter | A45C 13/02 206/223 |

(Continued)

*Primary Examiner* — Adam J Waggenspack

(74) *Attorney, Agent, or Firm* — Jim H. Salter; Inventive Law Inc.

(57) ABSTRACT

A yoga bag is disclosed. An example embodiment includes a yoga bag comprising: a fabric-covered rigid housing having a top panel and a bottom panel connected by two front panels and two rear panels, the combination of the top and bottom panels with the front and rear panels forming a generally rectangular housing with a hollow interior region; a yoga mat holder element attached to the top panel, the yoga mat holder element including at least one attachable strap to retain a rolled-up yoga mat; an accessory receptacle configured as a pocket, a loop, a hole, or an attachment mechanism to retain any of a variety of yoga accessories; and a towel storage area configured as an open area or void in the hollow interior region and positioned in the middle of the housing between the two front panels and the two rear panels.

10 Claims, 8 Drawing Sheets

(56) References Cited

U.S. PATENT DOCUMENTS

| | | | | |
|---|---|---|---|---|
| 2005/0172402 | A1 | 8/2005 | Uretzky-miller | |
| 2007/0095991 | A1* | 5/2007 | Fall | A45F 5/021 248/229.26 |
| 2008/0116239 | A1 | 5/2008 | Lu | |
| 2010/0032537 | A1 | 2/2010 | Andrews | |
| 2014/0069970 | A1 | 3/2014 | Thomas, Jr. | |
| 2017/0266485 | A1 | 9/2017 | Willis | |
| 2018/0279728 | A1 | 10/2018 | Marrello | |
| 2018/0353801 | A1 | 12/2018 | Ruse | |
| 2018/0353833 | A1 | 12/2018 | Croft | |
| 2019/0029385 | A1 | 1/2019 | Deeter | |

* cited by examiner

YOGA BAG

PRIORITY PATENT APPLICATION

This is a continuation-in-part (CIP) patent application drawing priority from U.S. patent application Ser. No. 16/297,184; filed Mar. 8, 2019. This present patent application claims priority to the referenced patent application. The entire disclosure of the referenced patent application is considered part of the disclosure of the present application and is hereby incorporated by reference herein in its entirety.

TECHNICAL FIELD

The disclosed subject matter relates to the field of utility luggage, baggage, and particularly although not exclusively, to a yoga bag.

COPYRIGHT

A portion of the disclosure of this patent document contains material that is subject to copyright protection. The copyright owner has no objection to the facsimile reproduction of the patent document or the patent disclosure, as it appears in the U.S. Patent and Trademark Office patent files or records, but otherwise reserves all copyright rights whatsoever. The following notice applies to the disclosure provided herein and to the drawings that form a part of this document: Copyright 2018-2020, Daniel SEARCY; All Rights Reserved.

BACKGROUND

There are many tools and accessories applicable to yoga, such as a yoga mat, a yoga ball, yoga bricks, yoga stretch straps, water bottles, towels, and the like. The yoga mat provides a soft surface to buffer impacts and provide protection during the posture practices or sitting meditation of a yoga session. Other tools and accessories can also be used before, during, or after a yoga exercise session. Because yoga is a specialized but not location-limited exercise, the yoga practioner needs to carry the many yoga tools and accessories for each session. However, the yoga tools and accessories can be inconvenient or cumbersome to carry. For example, the yoga mat may need a suspender or strap to carry, while the yoga balls or bricks may require a bag. Therefore, the yoga practioner needs a better way to gather, organize, and carry the tools and accessories applicable to the practice of yoga.

SUMMARY

A yoga bag is disclosed. The yoga bag of various example embodiments can be used to gather, organize, and carry the tools and accessories applicable to the practice of yoga. In particular, the yoga bag of various example embodiments can be used to retain yoga tools and accessories including a yoga mat, towel, yoga blocks, and a fan. In other example embodiments, the yoga bag can be augmented to include integrated speakers, a mobile device holder, and zippered side pockets to retain small items, such as keys, watches, wallets, mobile devices, etc. The various example embodiments are described in more detail below.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

A yoga bag is disclosed. The yoga bag of various example embodiments can be used to gather, organize, and carry the tools and accessories applicable to the practice of yoga. In particular, the yoga bag of various example embodiments can be used to retain yoga tools and accessories including a yoga mat, towel, yoga blocks, and a fan. In other example embodiments, the yoga bag can be augmented to include integrated speakers, a mobile device holder, and zippered side pockets to retain small items, such as keys, watches, wallets, mobile devices, etc.

Figure 1:
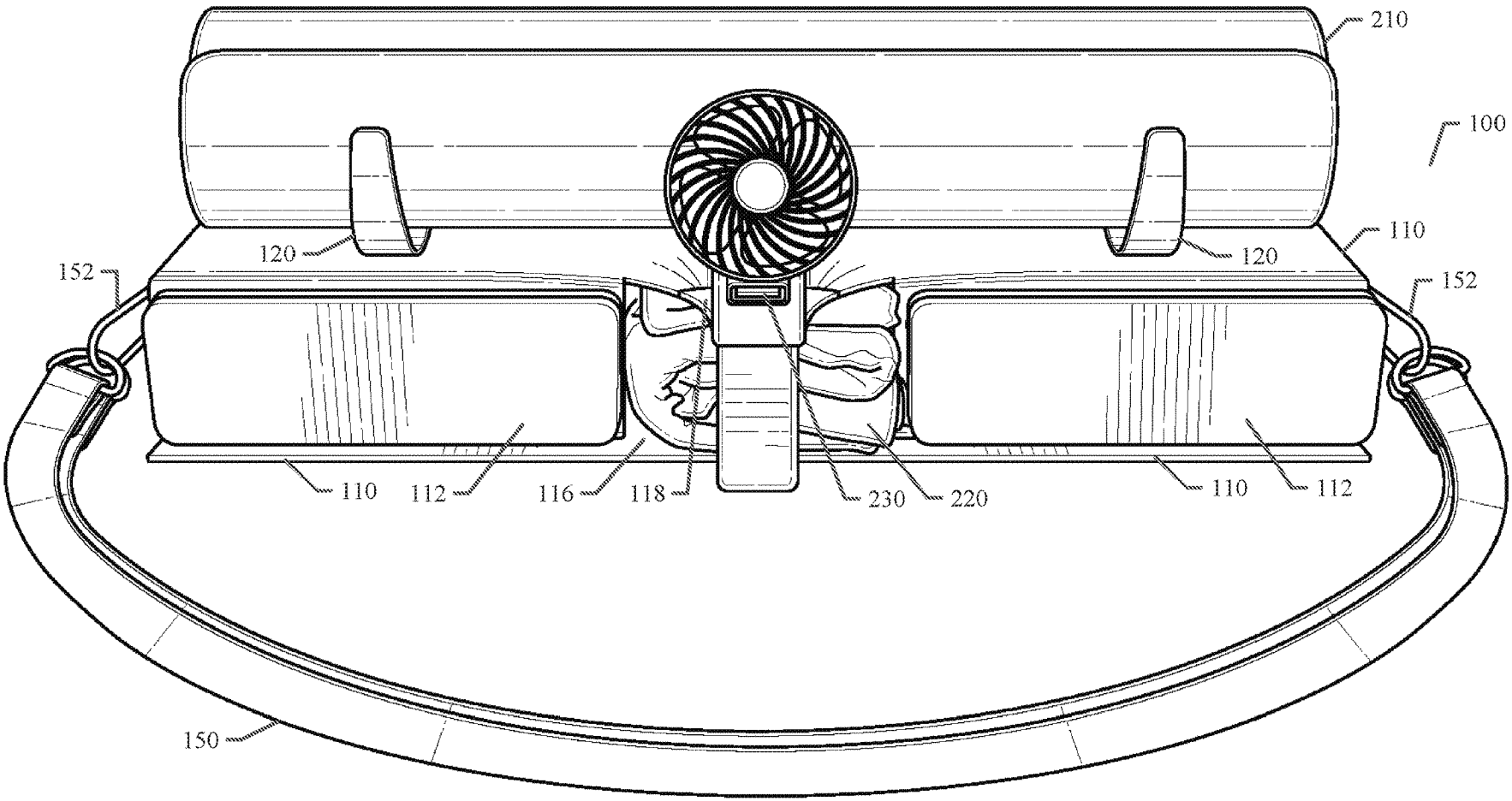
FIG. 1 illustrates a front perspective view of a yoga bag of an example embodiment securing various yoga tools and accessories and including a carry strap.

FIG. 1 illustrates a front perspective view of a yoga bag 100 of an example embodiment securing various yoga tools and accessories and including a carry strap 150. As shown, the yoga bag 100 is comprised of a housing 110 having fabric-covered rigid top and bottom panels connected by fabric-covered rigid front panels 112 and fabric-covered rigid rear panels 114 (shown in FIGS. 2 and 3). In general, the combination of the top and bottom panels with the front panels 112 and rear panels 114 form a generally rectangular housing with a hollow interior region. The front panels 112 and rear panels 114 can be flattened for storage when the yoga bag 100 is not in use.

In the example embodiment, the yoga bag housing 110 can be fabricated from duck cloth (e.g., back pack material), canvas, nylon or other synthetic material, leather, or other wear-resistant flexible material. The flexible material can be wrapped over a rigid rectangular panel, such as a plastic, cardboard, or wooden panel, to provide the rigidity of the surfaces of the housing 110. The flexible material can be provided in a variety of different colors. In the example embodiment, the housing 110 can be sized as a 26" long, 7" wide, and 5" tall rectangular cube with a hollow interior region. It will be apparent to those of ordinary skill in the art that alternative sizing can also be used. As shown in the diagrams provided herewith and described in more detail below, the yoga bag housing 110 can be configured to include a variety of storage areas and retention devices to conveniently hold and secure a variety of tools and accessories used before, during, or after the practice of yoga.

For example, referring again to FIG. 1, the yoga bag 100 of an example embodiment can include a pair of yoga mat holder elements 120 attached to the top panel of the housing 110. In the example embodiment, the yoga mat holders 120 can be plastic or metal components formed into a C-shape to conform to the round shape of a rolled-up yoga mat 210. The yoga mat holders 120 can be shaped to apply a slight gripping force to the yoga mat 210 when the mat 210 is pressed into the center of the yoga mat holders 120. In this manner, the yoga bag 100 of an example embodiment can conveniently retain a rolled-up yoga mat 210 in the yoga mat holders 120.

Referring again to FIG. 1, the yoga bag 100 of an example embodiment can include a towel storage area 116 configured as an open area or void positioned in the middle of the housing 110 between the two front panels 112 and two rear panels 114. The towel storage area 116 can be used for storage of a towel 220, items of clothing, or other items. The yoga bag 100 of an example embodiment can also include an accessory receptacle 118 configured as a pocket, a loop, a hole, or an attachment mechanism to retain any of a variety of yoga accessories, such as a portable fan 230. In the example embodiment, the portable fan 230 can be configured with a battery, charging station, or other capability to charge or power other electrical devices, such as mobile devices, music or audio players, and the like. The yoga bag 100 of an example embodiment can also include a carry strap 150, which can be attached to carry strap attachment clasps 152 affixed to the sides of the yoga bag housing 110.

Figure 2:
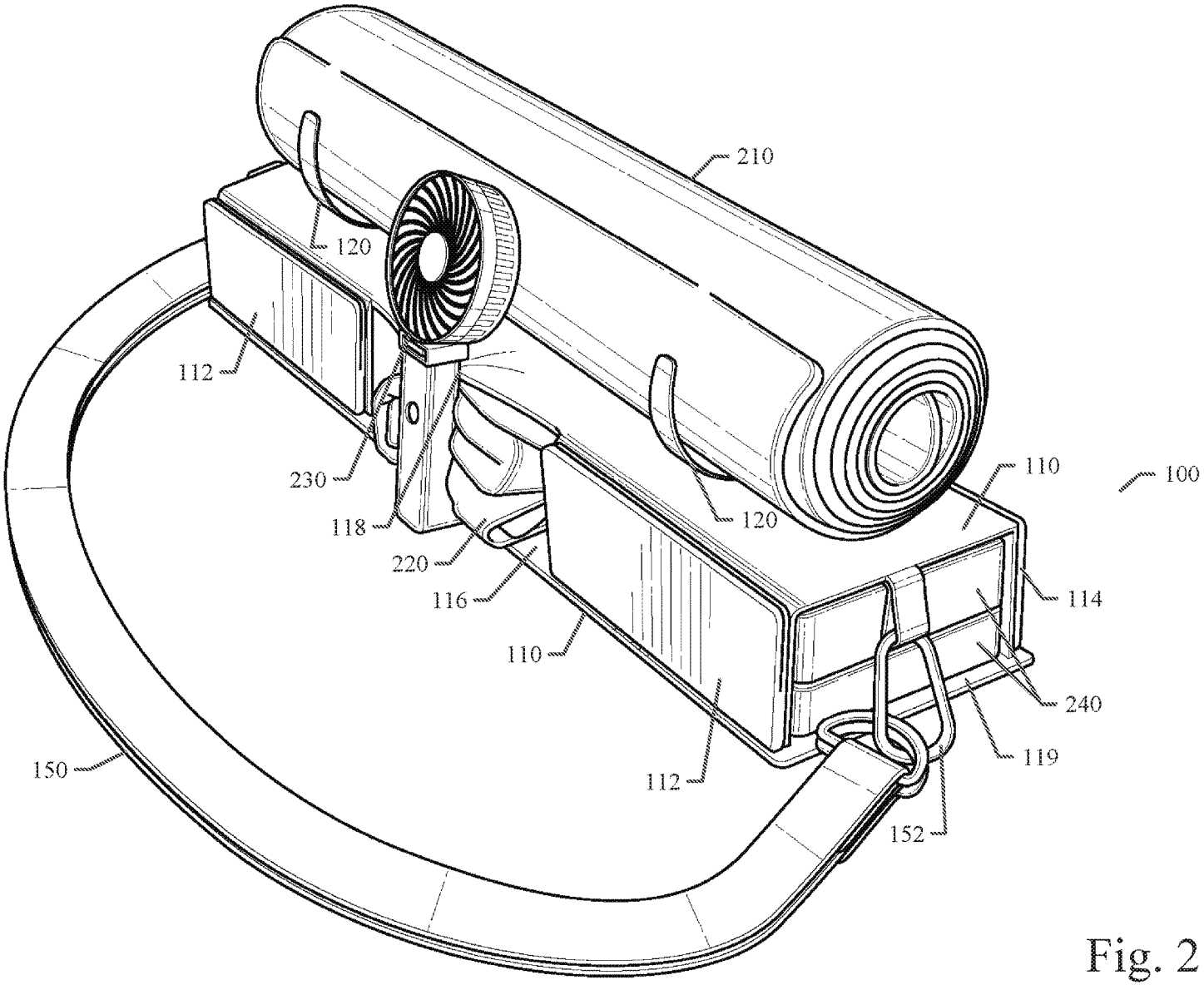
FIG. 2 illustrates a side perspective view of a yoga bag of an example embodiment securing various yoga tools and accessories and including a carry strap.

FIG. 2 illustrates a side perspective view of the yoga bag 100 of an example embodiment securing various yoga tools and accessories and including a carry strap 150. As shown in FIG. 2 and described above, the yoga bag 100 is comprised of the housing 110 having rigid top and bottom panels connected by rigid front panels 112 and rigid rear panels 114. The yoga bag 100, as described above, can include the yoga mat holder elements 120 to retain a rolled-up yoga mat 210, the towel storage area 116 retaining towel 220, the accessory receptacle 118 retaining the fan 230, and the carry strap 150 attached to the carry strap attachment clasps 152. Additionally, the yoga bag 100 of an example embodiment can include a yoga block storage area 119 configured as an open area or void positioned on a side of the housing 110 between a front panel 112 and a rear panel 114. The yoga block storage area 119 can be used for storage of yoga blocks 240 or other yoga accessories. In an alternative embodiment, a yoga block storage area 119 can be provided on both ends of the yoga bag housing 110.

Figure 3:
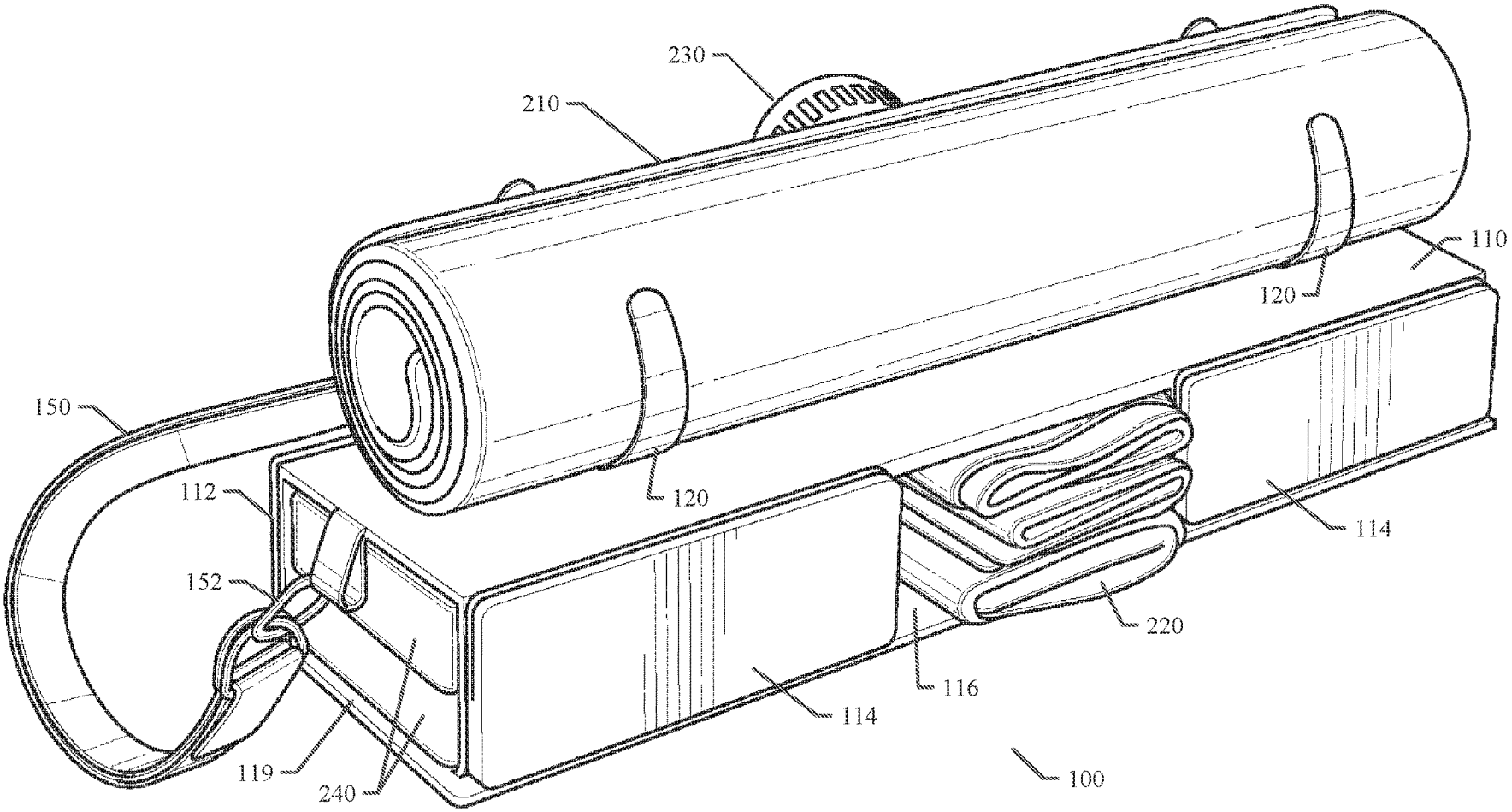
FIG. 3 illustrates a rear perspective view of a yoga bag of an example embodiment securing various yoga tools and accessories and including a carry strap.

FIG. 3 illustrates a rear perspective view of a yoga bag 100 of an example embodiment securing various yoga tools and accessories and including a carry strap 150. As shown in FIG. 3 and described above, the yoga bag 100 is comprised of the housing 110 having rigid top and bottom panels connected by rigid front panels 112 and rigid rear panels 114. The yoga bag 100, as described above, can include the yoga mat holder elements 120 to retain a rolled-up yoga mat 210, the towel storage area 116 retaining towel 220, the accessory receptacle 118 retaining the fan 230, and the carry strap 150 attached to the carry strap attachment clasps 152. Additionally, the yoga bag 100 of an example embodiment can include the yoga block storage area 119 configured as an open area or void positioned on a side of the housing 110 between a front panel 112 and a rear panel 114. The yoga block storage area 119 can be used for storage of yoga blocks 240 or other yoga accessories.

Figure 4:
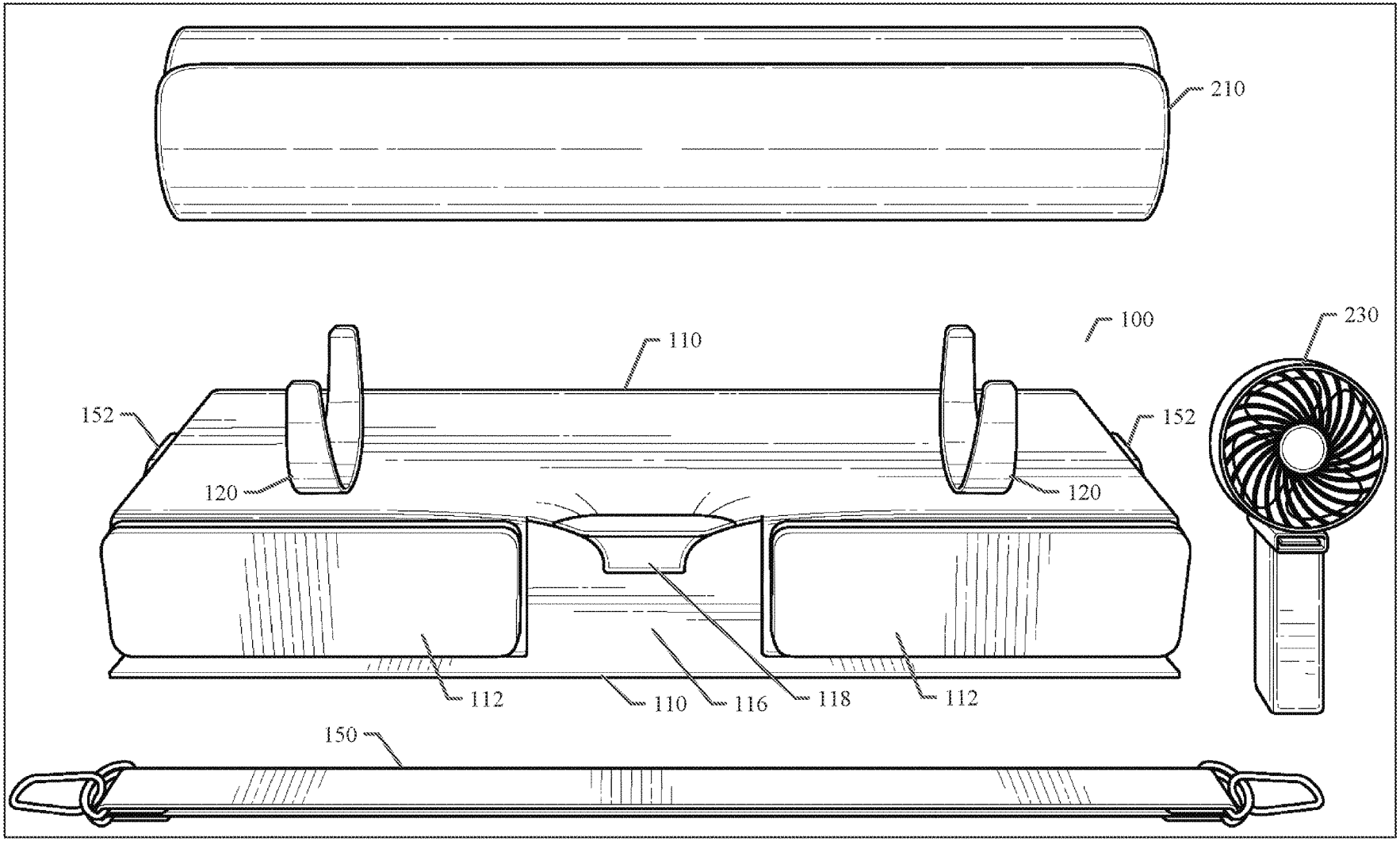
FIG. 4 illustrates an exploded view of a yoga bag and a carry strap of an example embodiment showing the various tools and accessories the yoga bag can store.

FIG. 4 illustrates an exploded view of a yoga bag 100 and a carry strap 150 of an example embodiment showing the various tools and accessories the yoga bag 100 can store. As shown in FIG. 4 and described above, the yoga bag 100 is comprised of the housing 110 having rigid top and bottom panels connected by rigid front panels 112 and rigid rear panels 114. The yoga bag 100, as described above, can include the yoga mat holder elements 120 to retain a rolled-up yoga mat 210, the towel storage area 116, the accessory receptacle 118 for retaining the fan 230, and the carry strap 150 for attachment to the carry strap attachment clasps 152.

Figure 5:
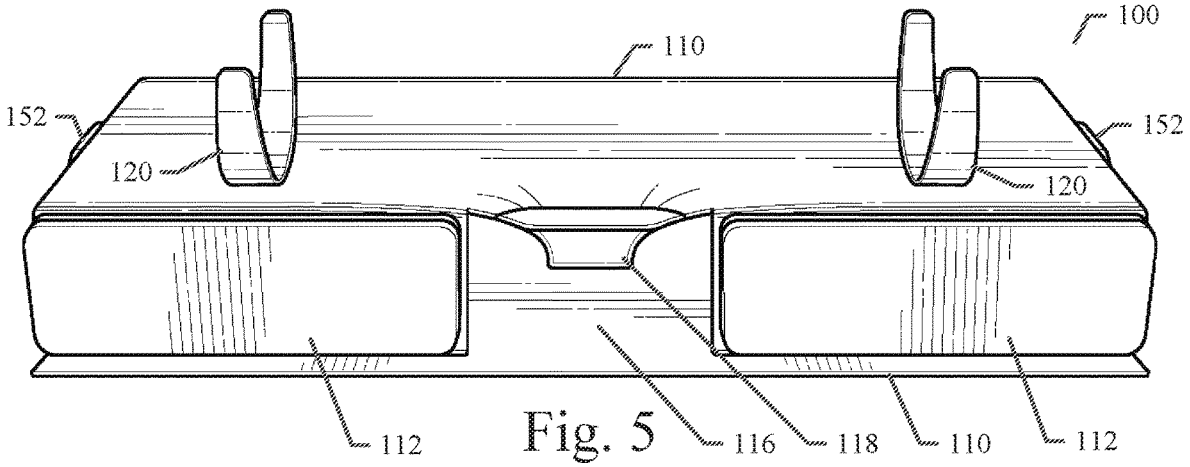
FIG. 5 illustrates a front perspective view of a yoga bag of an example embodiment without the yoga tools and accessories and without the carry strap.

FIG. 5 illustrates a front perspective view of a yoga bag 100 of an example embodiment without the yoga tools and accessories and without the carry strap 150. As shown in FIG. 5 and described above, the yoga bag 100 is comprised of the housing 110 having rigid top and bottom panels connected by rigid front panels 112 and rigid rear panels 114. The yoga bag 100, as described above, can include the yoga mat holder elements 120 to retain a rolled-up yoga mat 210, the towel storage area 116 to retain a towel 220, and the accessory receptacle 118 to retain the fan 230 or other yoga accessory. The yoga bag 100 also includes carry strap attachment clasps 152 for attachment of a carry strap 150 (not shown).

Figure 6:
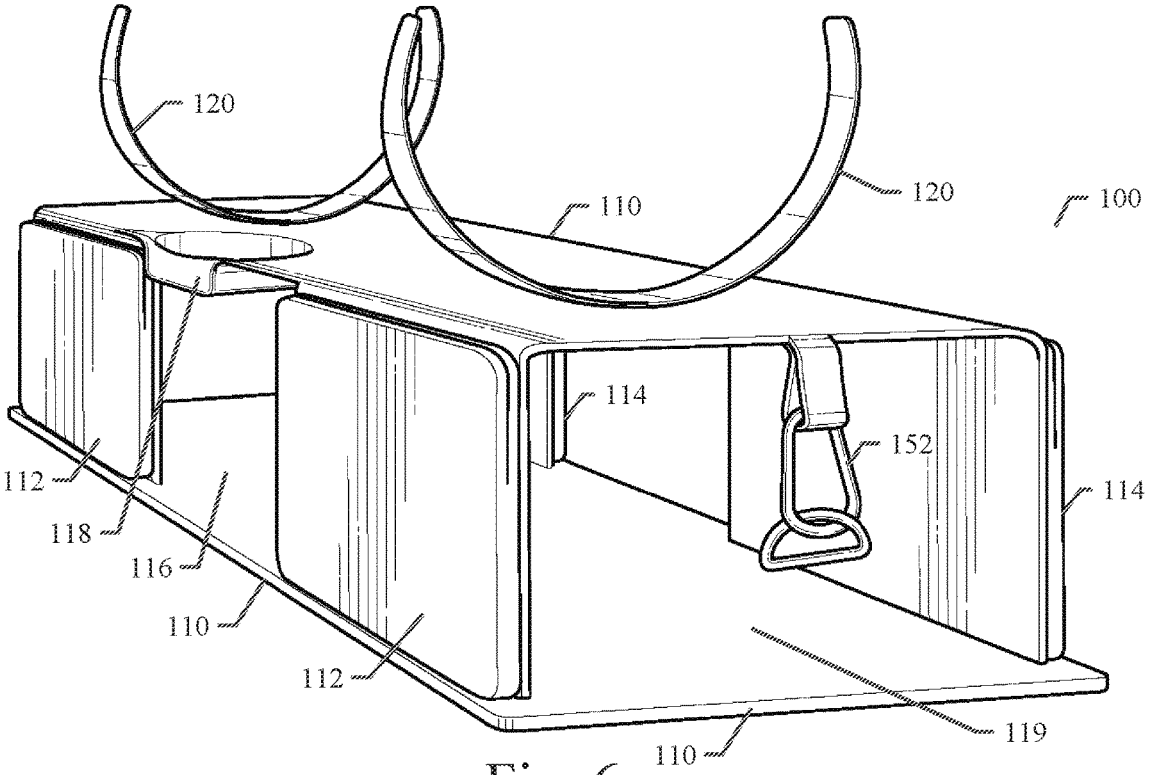
FIG. 6 illustrates a side perspective view of a yoga bag of an example embodiment without the yoga tools and accessories and without the carry strap.

FIG. 6 illustrates a side perspective view of a yoga bag 100 of an example embodiment without the yoga tools and accessories and without the carry strap 150. As shown in FIG. 6 and described above, the yoga bag 100 is comprised of the housing 110 having rigid top and bottom panels connected by rigid front panels 112 and rigid rear panels 114. The yoga bag 100, as described above, can include the yoga mat holder elements 120 to retain a rolled-up yoga mat 210, the towel storage area 116 to retain a towel 220, and the accessory receptacle 118 to retain the fan 230 or other yoga accessory. Additionally, the yoga bag 100 of an example embodiment can include the yoga block storage area 119 configured as an open area or void positioned on a side of the housing 110 between a front panel 112 and a rear panel 114. The yoga block storage area 119 can be used for storage of yoga blocks 240 or other yoga accessories. In an alternative embodiment, a yoga block storage area 119 can be provided on both ends of the yoga bag housing 110. The yoga bag 100 also includes carry strap attachment clasps 152 for attachment of a carry strap 150 (not shown).

Figure 7:
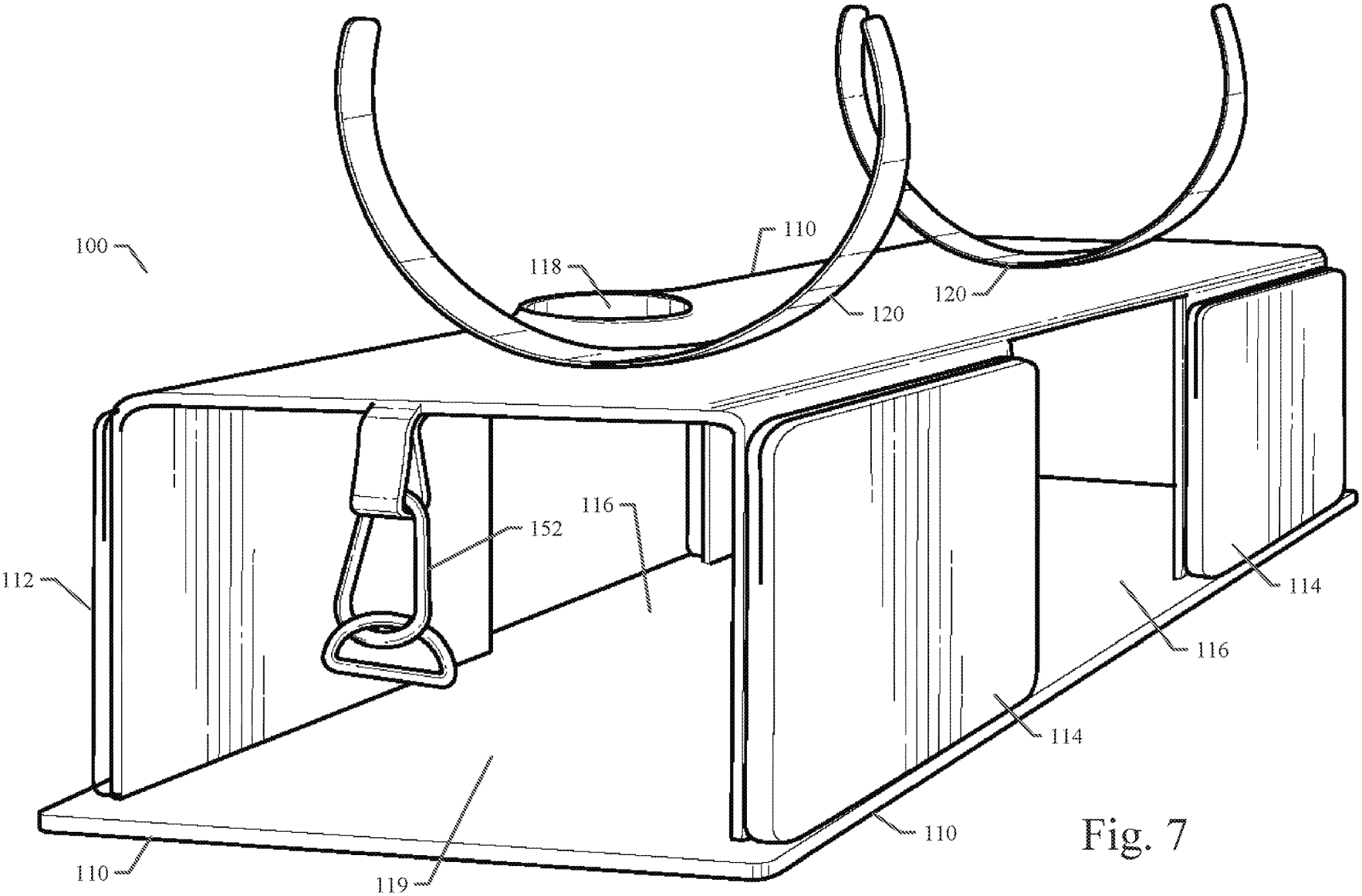
FIG. 7 illustrates a rear perspective view of a yoga bag of an example embodiment without the yoga tools and accessories and without the carry strap.

FIG. 7 illustrates a rear perspective view of a yoga bag 100 of an example embodiment without the yoga tools and accessories and without the carry strap 150. As shown in FIG. 7 and described above, the yoga bag 100 is comprised of the housing 110 having rigid top and bottom panels connected by rigid front panels 112 and rigid rear panels 114. The yoga bag 100, as described above, can include the yoga mat holder elements 120 to retain a rolled-up yoga mat 210, the towel storage area 116 to retain a towel 220, and the accessory receptacle 118 to retain the fan 230 or other yoga accessory. Additionally, the yoga bag 100 of an example embodiment can include the yoga block storage area 119 configured as an open area or void positioned on a side of the housing 110 between a front panel 112 and a rear panel 114. The yoga block storage area 119 can be used for storage of yoga blocks 240 or other yoga accessories. The yoga bag 100 also includes carry strap attachment clasps 152 for attachment of a carry strap 150 (not shown).

Figure 8:
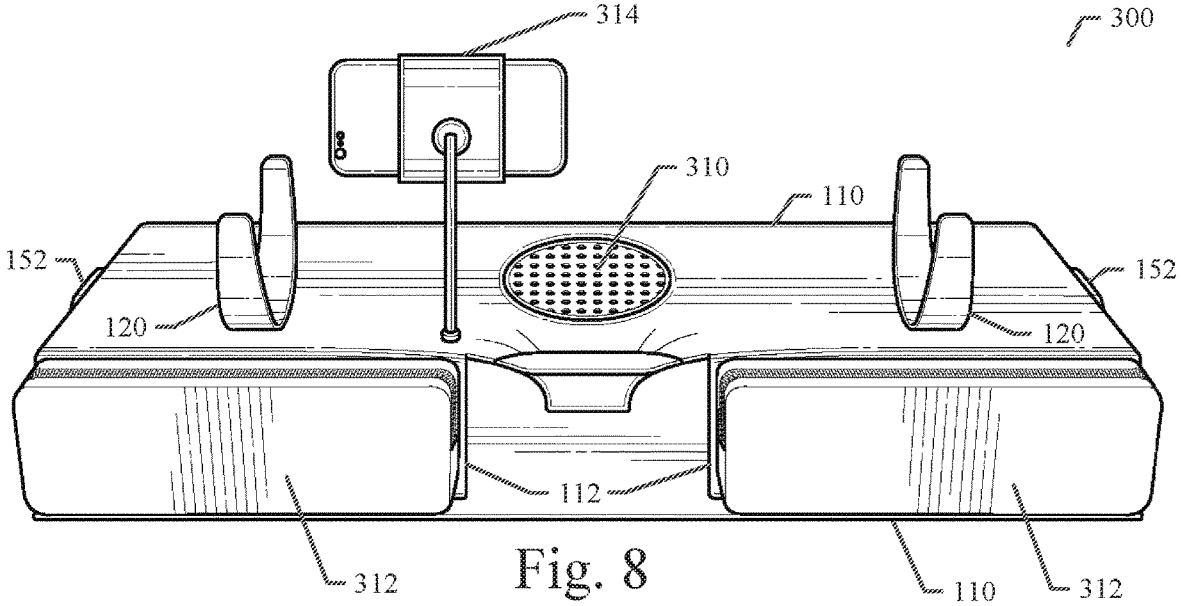
FIG. 8 illustrates a front perspective view of a yoga bag of an alternative example embodiment without the yoga tools and accessories and without the carry strap, but including additional features.

FIG. 8 illustrates a front perspective view of a yoga bag 300 of an alternative example embodiment without the yoga tools and accessories and without the carry strap 150, but including additional features. As shown in FIG. 8, the yoga bag 300 can include a built-in or integrated speaker 310. In the example embodiment, the integrated speaker 310 can use well-known Bluetooth™ technology or other wireless communication protocol to receive audio signals or data from a mobile device or other source of music or audio content. In other embodiments, the yoga bag 300 can provide an integrated speaker 310 on each end of the housing 110 to provide a stereophonic effect. As shown in FIG. 8, the yoga bag 300 can also include a built-in or integrated mobile device holder 314 to retain and support a mobile device, such as a mobile phone or audio player. Conventional mobile devices often support Bluetooth™ technology or other wireless communication protocols, which the mobile device can use to transmit music or audio content that is played through integrated speaker(s) 310. In the example embodiment shown in FIG. 8, the integrated mobile device holder 314 can include a fixed or telescoping rod to support the mobile device at a pre-defined distance or height above the top panel of the housing 110. The extended height provided by the integrated mobile device holder 314 provides better mobile device visibility and sound quality for the user.

In the example embodiment shown in FIG. 8, the yoga bag 300 of an alternative example embodiment can also include side zipper pockets 312 fabricated into or attached to each of the housing front panels 112 and optionally to each of the housing rear panels 114. In the example embodiment, each of the side zipper pockets 312 can include a top zipper and a pocket configured to be 9" long, 6" wide, and 4" tall. It will be apparent to those of ordinary skill in the art that alternative sizing can also be used. Additionally, the side zipper pockets 312 of the yoga bag 300 of the alternative example embodiment can also be configured to protrude outwardly from the housing front panels 112 up to 1.5". The side zipper pockets 312 can be used to retain small items, such as keys, watches, wallets, mobile devices, and the like.

Figure 9:
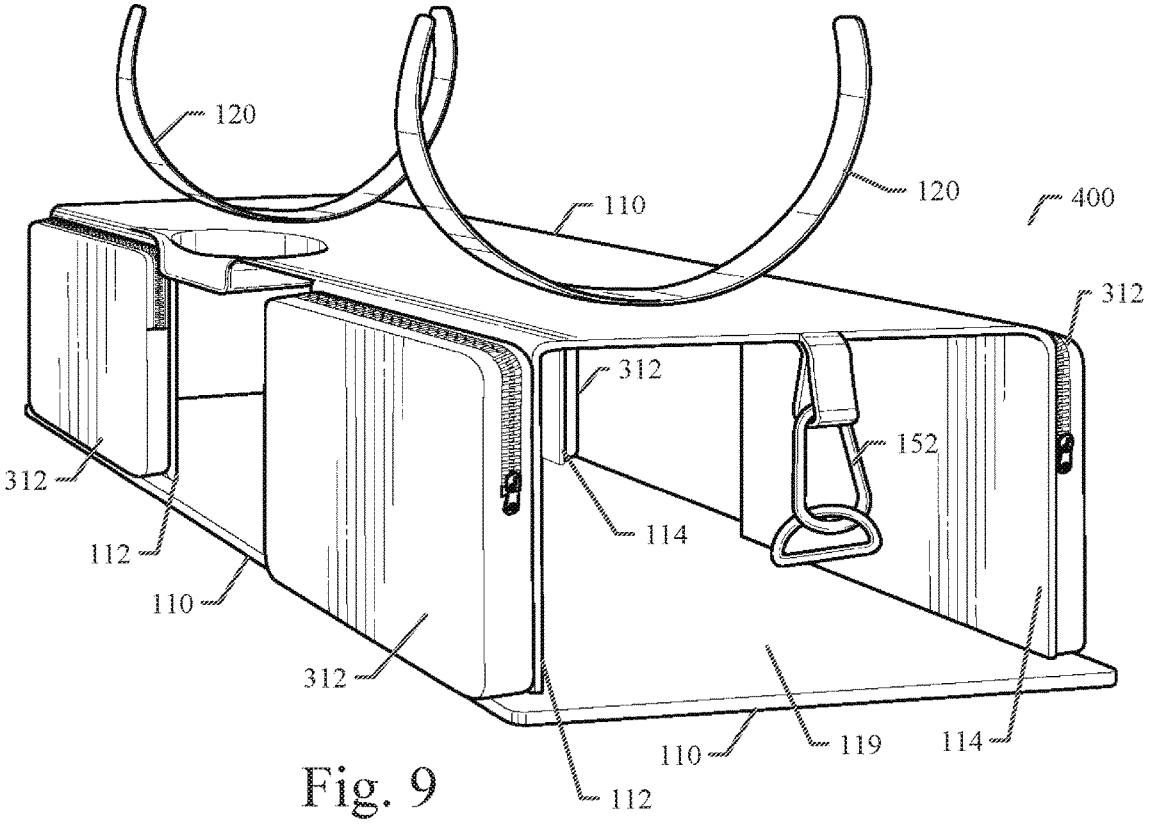
FIG. 9 illustrates a side perspective view of a yoga bag of another alternative example embodiment without the yoga tools and accessories and without the carry strap, but including additional features.

FIG. 9 illustrates a side perspective view of a yoga bag 400 of another alternative example embodiment without the yoga tools and accessories and without the carry strap 150, but including additional features. As shown in FIG. 9, the yoga bag 400 of an alternative example embodiment can include side zipper pockets 312 fabricated into or attached to each of the housing front panels 112 and optionally to each of the housing rear panels 114. In the example embodiment, each of the side zipper pockets 312 can include a top zipper and a pocket configured to be 9" long, 6" wide, and 4" tall. It will be apparent to those of ordinary skill in the art that alternative sizing can also be used. Additionally, the side zipper pockets 312 of the yoga bag 300 of the alternative example embodiment can also be configured to protrude outwardly from the housing front panels 112 up to 1.5". The side zipper pockets 312 can be used to retain small items, such as keys, watches, wallets, mobile devices, and the like.

Figure 10:
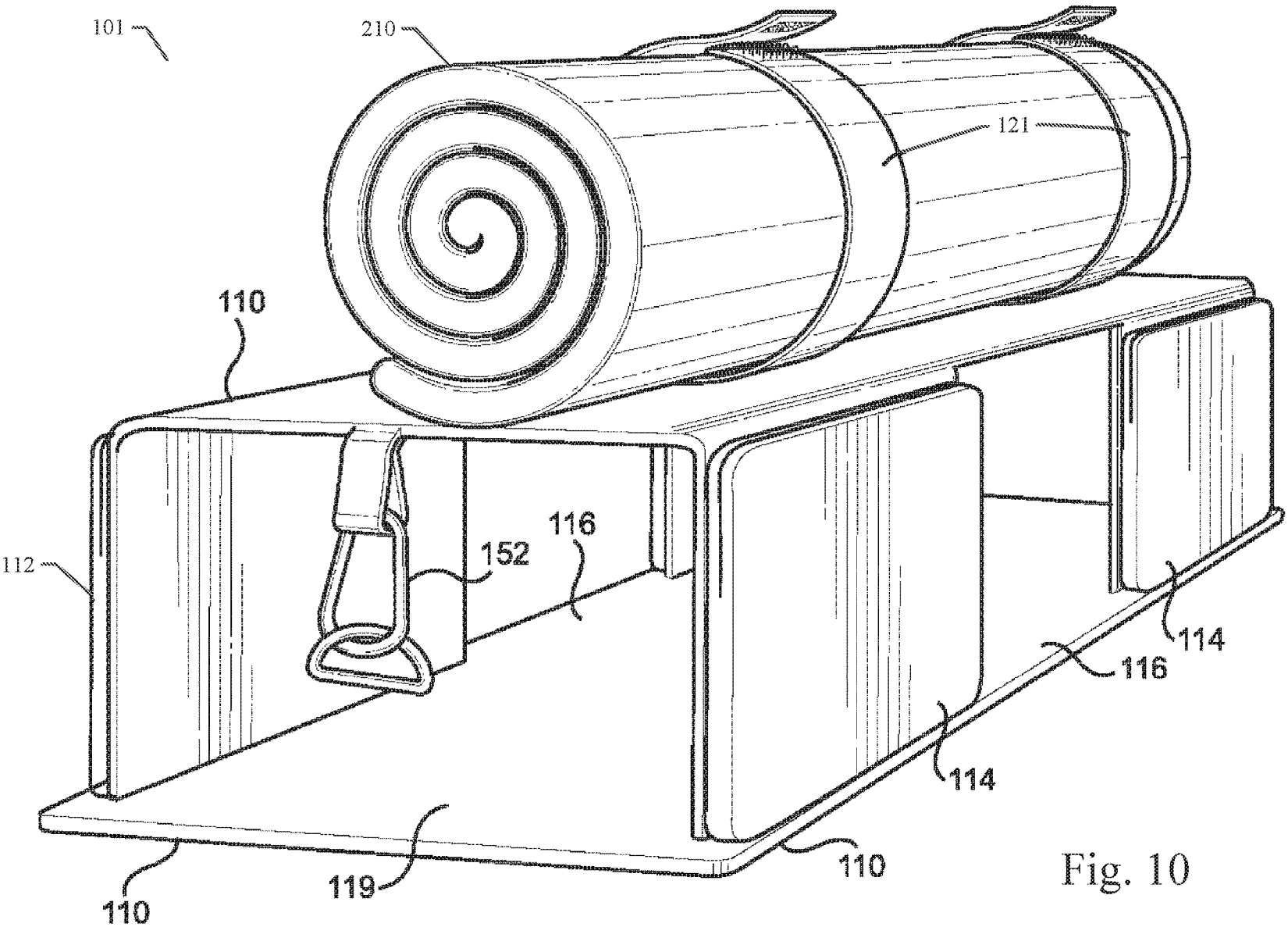
FIG. 10 illustrates another example embodiment of a yoga bag without the yoga tools and accessories and without the carry strap, but including attachable straps in place of the C-shaped mat holders.

FIG. 10 illustrates another example embodiment of a yoga bag 101 without the yoga tools and accessories and without the carry strap, but including attachable straps 121 in place of the C-shaped mat holders 120. For example, referring again to FIG. 10, the yoga bag 101 of an example embodiment can include one or more yoga mat holder elements 121 attached to the top panel of the housing 110. In the example embodiment, the yoga mat holder element 121 can be nylon, fabric, or leather straps configured to retain the rolled-up yoga mat 210. The yoga mat holder element 121 can be configured with Velcro™ attachment elements, buckles, clips, or other attachment mechanism at each end to enable the straps to removably attach at the ends of each of the attachable straps 121 as shown in FIG. 10. The attachable straps 121 can be configured with a length sufficient to enable a user to wrap the attachable straps 121 around a rolled-up yoga mat 210 and enable the ends of each of the attachable straps 121 to attach together to hold the rolled-up yoga mat 210 in place on the top panel of the housing 110 of the yoga bag 101. In this manner, the yoga bag 101 of an example embodiment can conveniently retain a rolled-up yoga mat 210 with the yoga mat holder element 121.

Although various example embodiments of the yoga bag 100 have been shown and described herein, other features and uses of the disclosed yoga bag can also be implemented and within the scope of the claims in the present application. For example, the various compartments, containers, open spaces, voids, receptacles, pockets, and attachment mechanisms as described herein can also be used to retain and secure other accessories, such as water bottles or drink containers, cold wet cloth or ice packs, clean or soiled clothing, flip flops or slippers, reading material, or the like.

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used only for descriptive purposes and not to be construed as limiting. The elements, materials, geometries, dimensions, and sequence of operations may all be varied for particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, a yoga bag is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A yoga bag comprising:

a fabric-covered rigid housing having a top panel and a bottom panel connected by two front panels and two rear panels, the combination of the top and bottom panels with the front and rear panels forming a generally rectangular housing with a hollow interior region;

a yoga mat holder element attached to the top panel, the yoga mat holder element including at least one attachable strap to retain a rolled-up yoga mat;

an accessory receptacle configured as a pocket, a loop, a hole, or an attachment mechanism to retain any of a variety of yoga accessories; and a towel storage area configured as an open area or void in the hollow interior region and positioned in the middle of the housing between the two front panels and the two rear panels.

2. The yoga bag of claim 1 including a carry strap attached to carry strap attachment clasps affixed to the housing.

3. The yoga bag of claim 1 including a rolled-up yoga mat retained in the yoga mat holder element.

4. The yoga bag of claim 1 including a fan retained in the accessory receptacle.

5. The yoga bag of claim 1 including a towel retained in the towel storage area.

6. The yoga bag of claim 1 including a yoga block storage area configured as an open area or void in the hollow interior region and positioned on a side of the housing between the front panel and the rear panel.

7. The yoga bag of claim 6 including yoga blocks retained in the yoga block storage area.

8. The yoga bag of claim 1 wherein the fabric-covered rigid housing is constructed with a fabric of a type from the group consisting of: duck cloth or back pack material, canvas, nylon, a synthetic material, leather, and a wear-resistant flexible material.

9. The yoga bag of claim 1 wherein the fabric-covered rigid housing is constructed with flexible material wrapped over a rigid rectangular panel, the rigid panel fabricated from a material of a type from the group consisting of: plastic, cardboard, and wood.

10. The yoga bag of claim 1 wherein the housing is configured as a rectangular cube with a hollow interior region of a size at least 26" long, at least 7" wide, and at least 5" tall.

* * * * *